US007458621B2

(12) United States Patent
Fujihara et al.

(10) Patent No.: US 7,458,621 B2
(45) Date of Patent: Dec. 2, 2008

(54) DOOR CONNECTOR

(75) Inventors: Yoshihiko Fujihara, Yamanashi (JP); Mikio Ichinose, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 11/151,299

(22) Filed: Jun. 14, 2005

(65) Prior Publication Data

US 2006/0006672 A1 Jan. 12, 2006

(30) Foreign Application Priority Data

Jun. 15, 2004 (JP) ..... 2004-177448
Jun. 15, 2004 (JP) ..... 2004-177449

(51) Int. Cl.
*E05C 3/06* (2006.01)

(52) U.S. Cl. ..... 292/216; 292/201; 292/DIG. 23; 49/502; 49/503; 49/142; 49/143

(58) Field of Classification Search ..... 292/216, 292/DIG. 21, DIG. 3, 341.16, 201, DIG. 23, 292/DIG. 46; 296/146.11, 148.8, 146.9, 296/155; 49/503, 502, 142, 143
See application file for complete search history.

(56) References Cited

U.S. PATENT DOCUMENTS 3,999,791 A * 12/1976 Torii ..... 292/216
4,364,249 A * 12/1982 Kleefeldt ..... 70/264
5,032,845 A * 7/1991 Velasco ..... 342/457
5,180,198 A * 1/1993 Nakamura et al. ..... 292/201
5,181,754 A * 1/1993 Shibata ..... 292/216
5,277,461 A * 1/1994 Dzurko et al. ..... 292/216
5,427,421 A * 6/1995 Hamaguchi ..... 292/216
5,603,537 A * 2/1997 Amano et al. ..... 292/201
5,708,409 A * 1/1998 Schwimmer et al. ... 340/426.28
6,062,613 A * 5/2000 Jung et al. ..... 292/201
6,184,783 B1 * 2/2001 Sumida ..... 340/438
6,694,676 B2 * 2/2004 Sakamoto et al. ..... 49/366
6,926,340 B2 * 8/2005 Moriyama ..... 296/146.6
6,955,389 B2 * 10/2005 Suzuki et al. ..... 296/146.4
2003/0122426 A1 * 7/2003 Aiyama et al. ..... 307/10.1
2003/0222758 A1 * 12/2003 Willats et al. ..... 340/5.72

FOREIGN PATENT DOCUMENTS

JP 2004-27557 A 1/2004

* cited by examiner

*Primary Examiner*—Patricia Engle
*Assistant Examiner*—Mark Williams
(74) *Attorney, Agent, or Firm*—Sughrue Mion, PLLC

(57) ABSTRACT

One actuator selectively operates a latch lever linked to a latch and a ratchet lever, a push rod, a bell crank and a pull rod linked to a ratchet. When the front door and the rear door of a car having the center pillarless design are closed, the actuator operates the latch lever causing the latch to engage with a striker to connect the front door and the rear door. When the front door and the rear door are connected and a passenger opens either of the two doors, the actuator operates the ratchet lever, the push rod, the bell crank, and the pull rod causing the latch and the striker to be disengaged to disconnect the front door and the rear door.

16 Claims, 9 Drawing Sheets

DOOR CONNECTOR

CROSS REFERENCE TO RELATED APPLICATIONS

The present invention benefits from the prior claims and incorporates the entire contents of Japanese Patent Application No. 2004-177448 filed on Jun. 15, 2004 and Japanese Patent Application No. 2004-177449 filed on Jun. 15, 2004.

BACKGROUND OF THE INVENTION

1) Field of the Invention

The present invention relates to a door connector that connects a front door and a rear door of a car having a so-called center pillarless design.

2) Description of the Related Art

Some cars have a so-called center pillarless design in which a front door and a rear door close the continuous opening formed in the anteroposterior direction of the car. In such cars, the front door and the rear door can be opened independently and a door connector connects the front door and the rear door with each other when the doors are closed. Because the front door and the rear door are firmly connected with the door connector, it helps to protect the space in the compartment of the car in case there is lateral collision.

The door connector connects the front door and the rear door by means of a striker provided on either of the two doors, and a latch device provided on the other door. The latch device includes a latch that engages with the striker and a ratchet that engages with the latch. The latch is linked to a close actuator, and when both the doors are closed, the close actuator operates the latch to connect the front door and the rear door. The ratchet is linked to a release actuator, and when either the front door or the rear door is opened, the release actuator operates the ratchet to disengage the latch and the striker, thereby disconnecting the front door and the rear door connected to each other. Such a door connector has been disclosed in Japanese Patent Laid-Open Publication No. 2004-27557.

However, in the conventional door connector, the close actuator is operated to connect the front door and the rear door, and the release actuator is operated to disconnect the front door and the rear door connected to each other. Thus, in the conventional door connector, two actuators are needed, thereby increasing the parts and making the door connector expensive.

Moreover, in the conventional door connector, the front door and the rear door are connected when both the doors are closed. Thus, for example, if a passenger occupying a rear seat gets out of the car and closes the rear door followed by a passenger occupying the front passenger seat (front seat) getting out of the car or vice versa, the front door and the rear door are repeatedly connected and disconnected although the car is not running. In other words, when the passenger occupying the rear seat opens the rear door to get out of the car, the front door and the rear door connected to each other are first disconnected, and when the passenger closes the rear door after getting out, the front door and the rear door are again connected to each other. Subsequently, when the passenger occupying the front passenger seat opens the front door to get out, the front door and the rear door connected to each other are first disconnected, and when the passenger closes the front door after getting out, the front door and the rear door are again connected.

As a result, the number of operations of the door connector far exceeds the number of operations of an upper latch mechanism and a lower latch mechanism that maintain the closed condition of the front door, and a rear latch mechanism that maintains the closed condition of the rear door. Thus, if the durability of the door connector is the same as the durability of the latch mechanisms, the door connector is likely to wear out earlier than the latch mechanisms. Hence, the durability of the door connector needs to be improved if the door conductor is to have the same product life as that of the latch mechanisms.

SUMMARY OF THE INVENTION

It is an object of the present invention to at least solve the problems in the conventional technology.

According to an aspect of the present invention, a door connector for connecting a first door and a second door that close an opening formed in the anteroposterior direction of a car comprises a striker provided on the first door; a notch, a latch, and a ratchet that are provided on the second door, wherein the notch receives the striker, the latch engages with the striker, and the ratchet engages with the latch; a latch linking mechanism linked to the latch; a ratchet linking mechanism linked to the ratchet; and an actuator that selectively operates the latch linking mechanism and the ratchet linking mechanism, wherein the actuator operates the latch linking mechanism causing the latch to engage with the striker to connect the first door and the second door when both the first door and the second door are closed, and the actuator operates the ratchet linking mechanism causing the latch and the striker to be disengaged to disconnect the first door and the second door when both the first door and the second door are connected and either of the first door and the second is opened.

According to another aspect of the present invention, a door connector for connecting a first door and a second door that close an opening formed in the anteroposterior direction of a car comprises a striker provided on the first door; a notch, a latch, and a ratchet that are provided on the second door, wherein the notch receives the striker, the latch engages with the striker, and the ratchet engages with the latch; and a latch linking mechanism linked to the latch, wherein the latch linking mechanism is operated causing the latch to engage with the striker to connect the first door and the second door when both the first door and the second door are closed and the car satisfies predetermined running conditions.

The other objects, features, and advantages of the present invention are specifically set forth in or will become apparent from the following detailed description of the invention when read in conjunction with the accompanying drawings.

DETAILED DESCRIPTION

Exemplary embodiments of the present invention are explained below with reference to accompanying drawings. The present invention is not limited to these embodiments.

Figure 1:
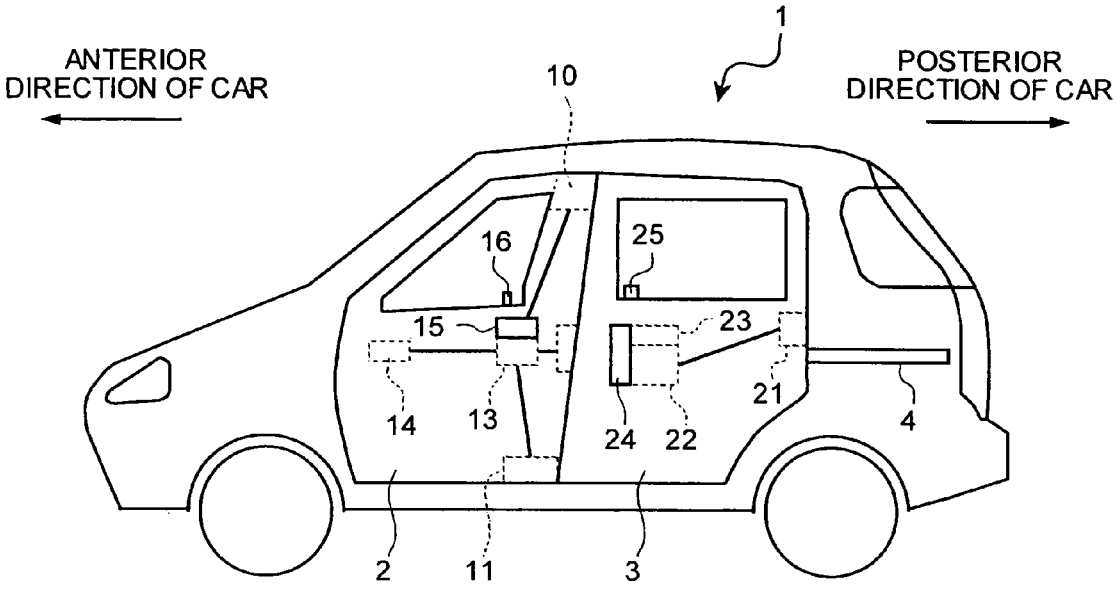
FIG. 1 is a schematic diagram of an outline of a car that adapts a door connector according to an embodiment of the present invention.
Figure 2:
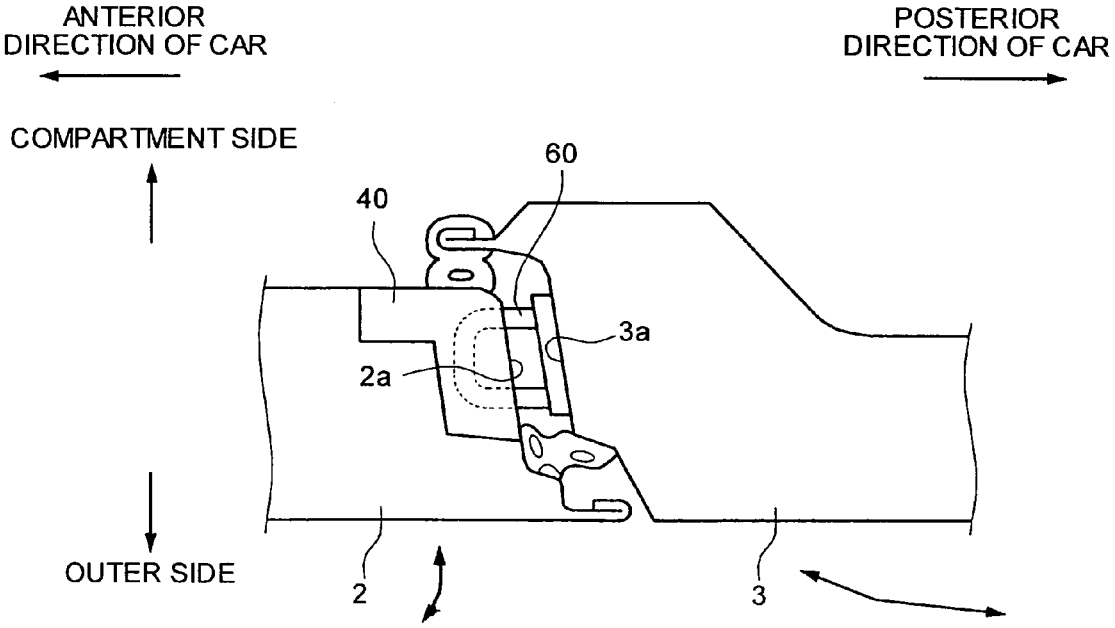
FIG. 2 is a cross sectional view of a seam of a front door and a rear door of the car shown in FIG. 1.

FIG. 1 is a schematic diagram of an outline of a car 1 that adapts a door connector according to an embodiment of the present invention. FIG. 2 is a cross sectional view of a seam of a front door and a rear door of the car shown in FIG. 1. FIG. 3A through FIG. 3D are rear external views of the door connector shown in FIG. 1.

The car 1 has the center pillarless design. In other words, the car 1 has a continuous opening formed in the anteroposterior direction of the car 1, and a front door 2 and a rear door 3 close or open this opening. The front door 2 is pivotably supported by means of a front hinge (not shown), and the rear door 3 is supported so as to slide in the anteroposterior direction of the car 1. Thus, the continuous opening in the car 1 can be closed or opened by pivoting the front door 2 along the front hinge and sliding the rear door 3.

An upper latch mechanism 10 is provided in the upper rear part of the front door 2, and a lower latch mechanism 11 is provided in the lower rear part of the front door 2. These latch mechanisms engage with a not shown striker fixed to the car body, thereby closing the front door 2. Because the latch mechanisms are known in the art, their detailed explanation will be omitted.

Operations of the upper latch mechanism 10 and the lower latch mechanism 11 are controlled by a front remote control 13. The upper latch mechanism 10 and the lower latch mechanism 11 maintain the closed state of the front door 2 when the front door 2 is closed, and release the closed state to open the front door 2 based on an instruction from the front remote control 13.

An inside handle 14 is provided on the compartment side of the front door 2 and an outer handle 15 is provided on the outer side of the front door 2. The inside handle 14 and the outer handle 15 are coupled with the front remote control 13. When a passenger operates the inside handle 14 or the outer handle 15, the front remote control 13 sends the instruction to the upper latch mechanism 10 and the lower latch mechanism 11, thereby releasing the closed state of the front door 2.

A lock unlock knob 16 that is connected to the front remote control 13 is provided on the compartment side of the front door 2. When the lock unlock knob 16 is in a locked state, the front remote control 13 disables the operation of the inside handle 14 and the outer handle 15, and the upper latch mechanism 10 and the lower latch mechanism 11 maintain the closed state of the front door 2 even if a passenger operates the inside handle 14 or the outer handle 15. When the lock unlock knob 16 is in an unlocked state, the front remote control 13 sends the instruction to the upper latch mechanism 10 and the lower latch mechanism 11 when a passenger operates the inside handle 14 or the outer handle 15, thereby releasing the closed state of the front door 2.

Rollers (not shown) are provided on the upper front part, the lower front part, and the central rear part of the rear door 3 and these rollers support the rear door 3. These rollers roll on a rail 4 fixed in the upper part, the lower part, and the central rear part of the continuous opening of the car 1, thereby enabling the rear door 3 to be opened or closed by sliding on the rollers.

A rear latch mechanism 21 is provided at substantially a center of the rear part of the rear door 3. The rear latch mechanism 21 engages with a striker (not shown) that is fixed to the car body, thereby closing the rear door 3. Because such a latch mechanism is known in the art, detailed explanation thereof will be omitted. Operations of the rear latch mechanism 21 are controlled by a rear remote control 22. The rear latch mechanism 21 maintains the closed state of the rear door 3 when the rear door 3 is closed, and release the closed state of the rear door 3 to open the rear door 3 based on an instruction from the rear remote control 22.

An inside handle 23 is provided on the compartment side of the rear door 3, and an outer handle 24 is provided on the outer side of the rear door 3. The inside handle 23 and the outer handle 24 are coupled with the rear remote control 22. When a passenger operates the inside handle 23 or the outer handle 24, the rear remote control 22 sends the instruction to the rear latch mechanism 21, thereby releasing the closed state of the rear door 3.

A lock unlock knob 25 that is connected to the rear remote control 22 is provided on the compartment side of the rear door 3. When the lock unlock knob 25 is in a locked state, the rear remote control 22 disables the operation of the inside handle 23 and the outer handle 24, and the rear latch mechanism 21 maintains the closed state of the rear door 3 even if a passenger operates the inside handle 23 or the outer handle 24. When the lock unlock knob 25 is in an unlocked state, the rear remote control 22 operates the rear latch mechanism 21 when a passenger operates the inside handle 23 or the outer handle 24, thereby releasing the closed state of the rear door 3.

As shown in FIG. 2, the front door 2 includes a rear edge 2*a*, which is somewhat inclined in the anterior direction of the car 1 from the outer side towards the compartment side. The rear door 3 includes a front edge 3*a*, which is substantially parallel to the rear edge 2*a* of the front door 2 and inclined from the outer side towards the compartment side. When both the front door 2 and the rear door 3 are closed, the front edge 3*a* of the rear door 3 and the rear edge 2*a* of the front door 2 overlap with each other.

A latch device 40 is provided substantially along the rear edge 2*a* of the front door 2, and a U-shaped striker 60 is provided on the front edge 3*a* of the rear door 3. The latch device 40 and the striker 60 form a door connector that connects the front door 2 and the rear door 3.

A front door, a rear door, and a door connector that have substantially the same structure as the front door 2, the rear door 3, and the door connector can be provided on the other side of the car 1.

As shown in FIG. 3A through FIG. 3D, the latch device 40 includes a cover plate (not shown), a housing 42, and a back plate (not shown). A latch mechanism housing 44 is provided on the surface of the housing 42 facing the rear side of the car 1. The latch mechanism housing 44 includes a horizontal notch 45 extending substantially horizontally from the compartment side towards the outer side at a substantially central position in the direction of its height. The latch mechanism housing 44 houses a latch mechanism. When both the front door 2 and the rear door 3 are closed, the striker 60 moves into the horizontal notch 45. When the front door 2 is closed first and the rear door 3 is closed next, the striker 60 moves into the horizontal notch 45 by moving from the posterior direction towards the anterior direction of the car 1. When the rear door 3 is closed first and the front door 2 is closed next, the striker 60 moves into the horizontal notch 45 by moving from the compartment side towards the outer side.

The latch mechanism maintains the engaged condition of the striker 60 provided substantially centrally on the rear door 3, and includes a latch 47 and a ratchet 48.

The latch 47 can be rotated via a latch bar 49 that extends substantially horizontally along the anteroposterior direction at a position below the horizontal notch 45 of the latch mechanism housing 44. A striker engagement member 471 and a ratchet engagement member 472 are included on the exterior surface of the latch 47 that extend in the radially outward direction of the latch bar 49.

Figure 3A:
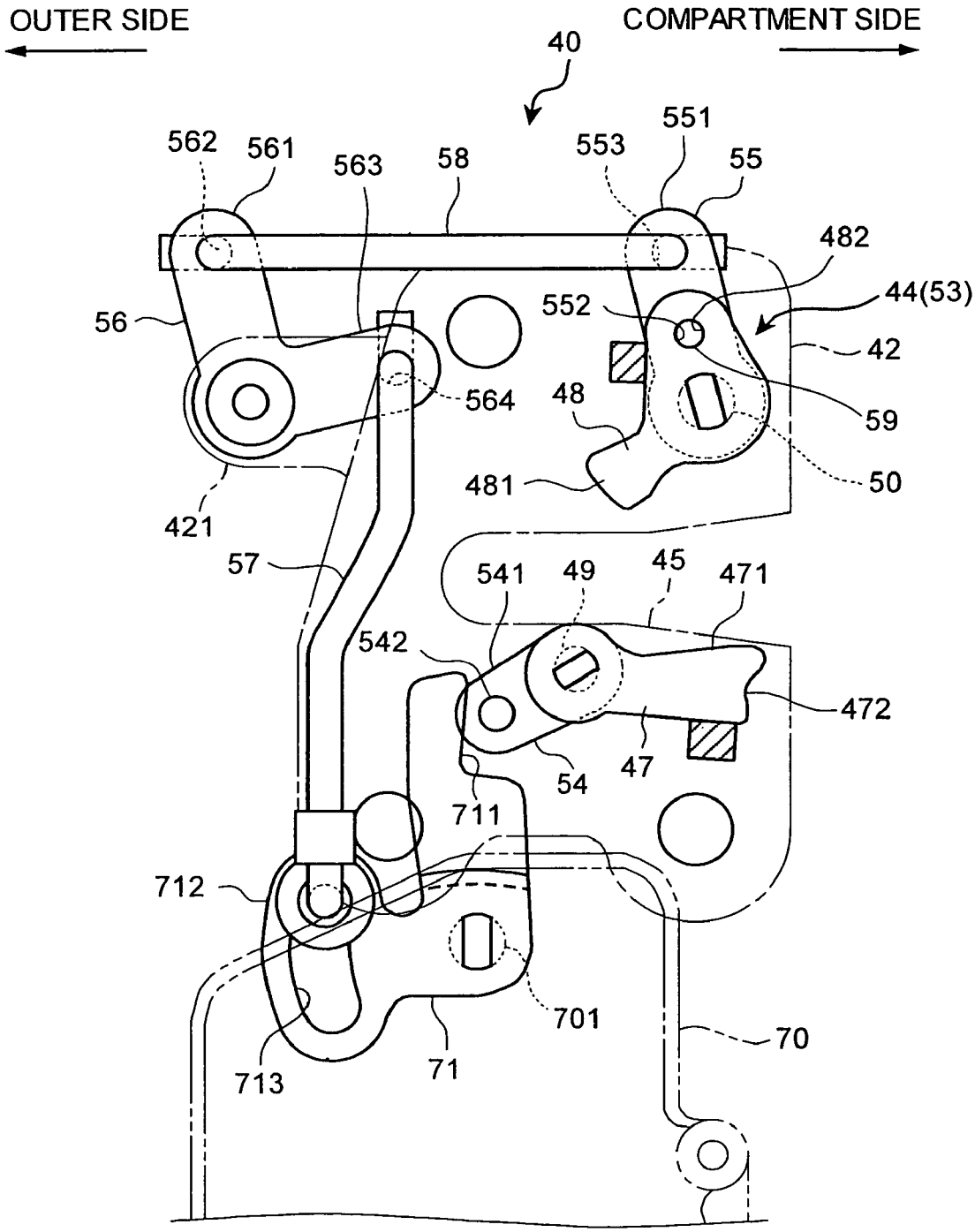
FIG. 3A is a rear external view of the door connector without a cover plate when the front door and the rear door are opened.
Figure 3B:
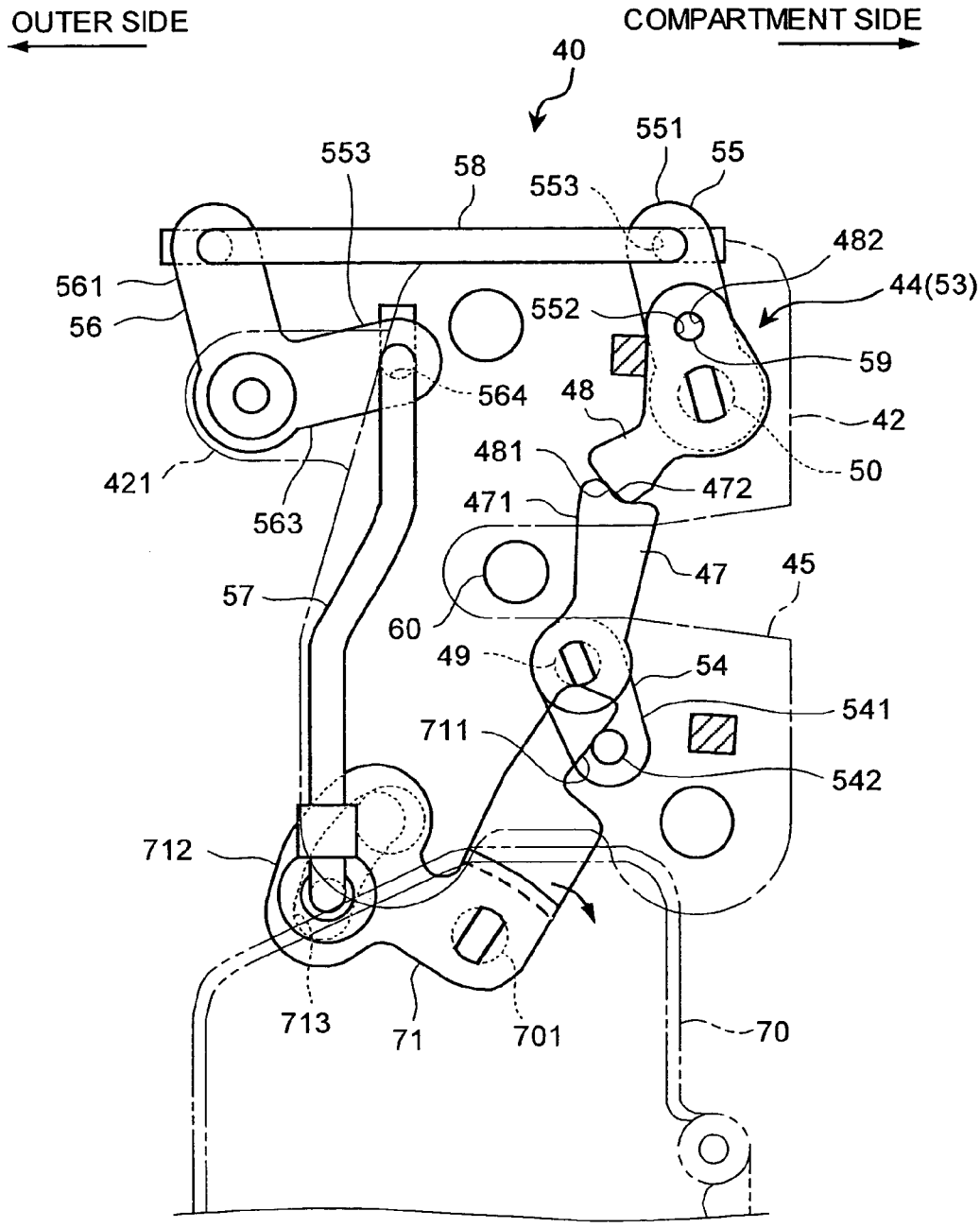
FIG. 3B is a rear external view of the door connector without a cover plate when the front door and the rear door are connected.
Figure 3C:
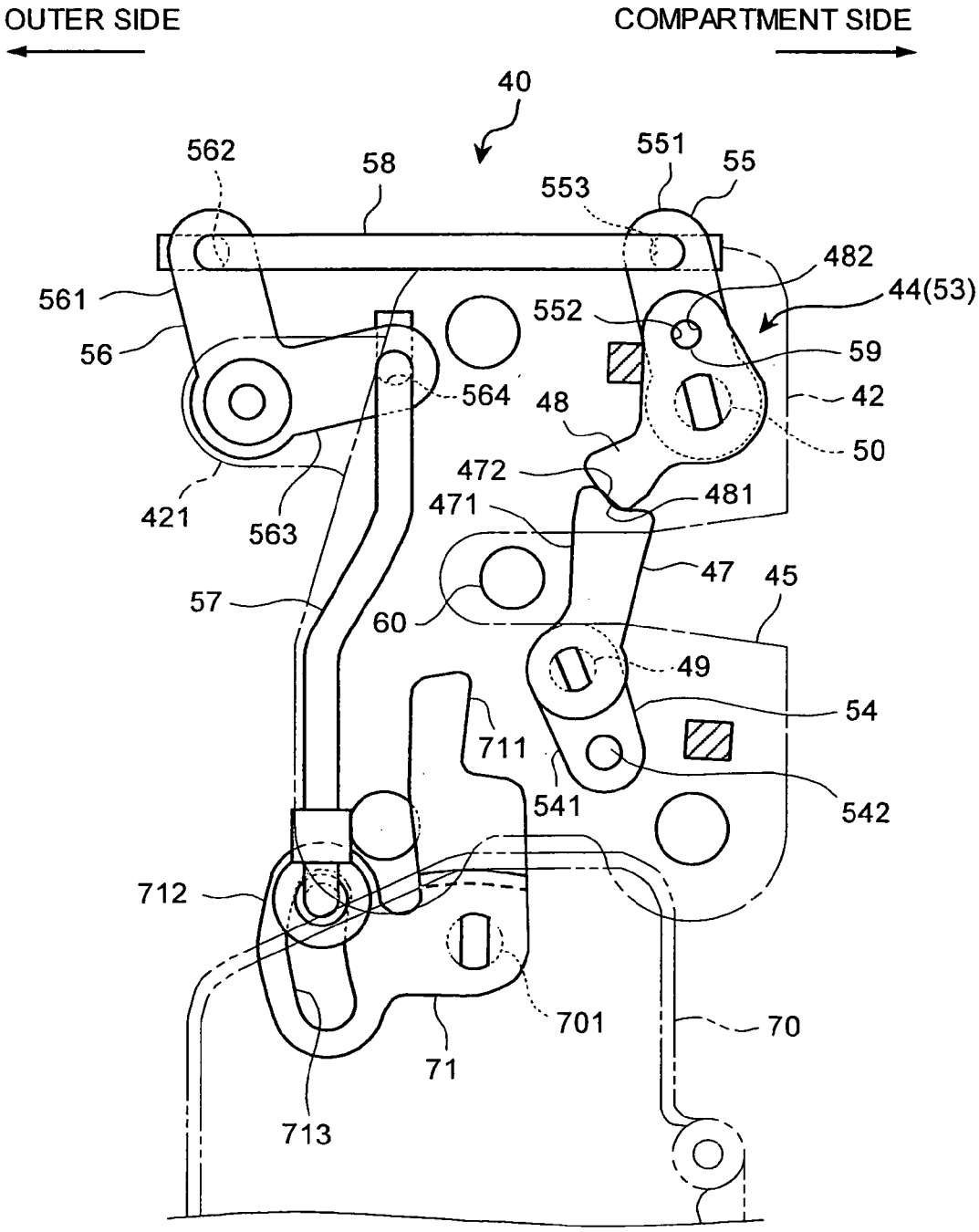
FIG. 3C is a rear external view of the door connector without a cover plate when the front door and the rear door are opened.
Figure 3D:
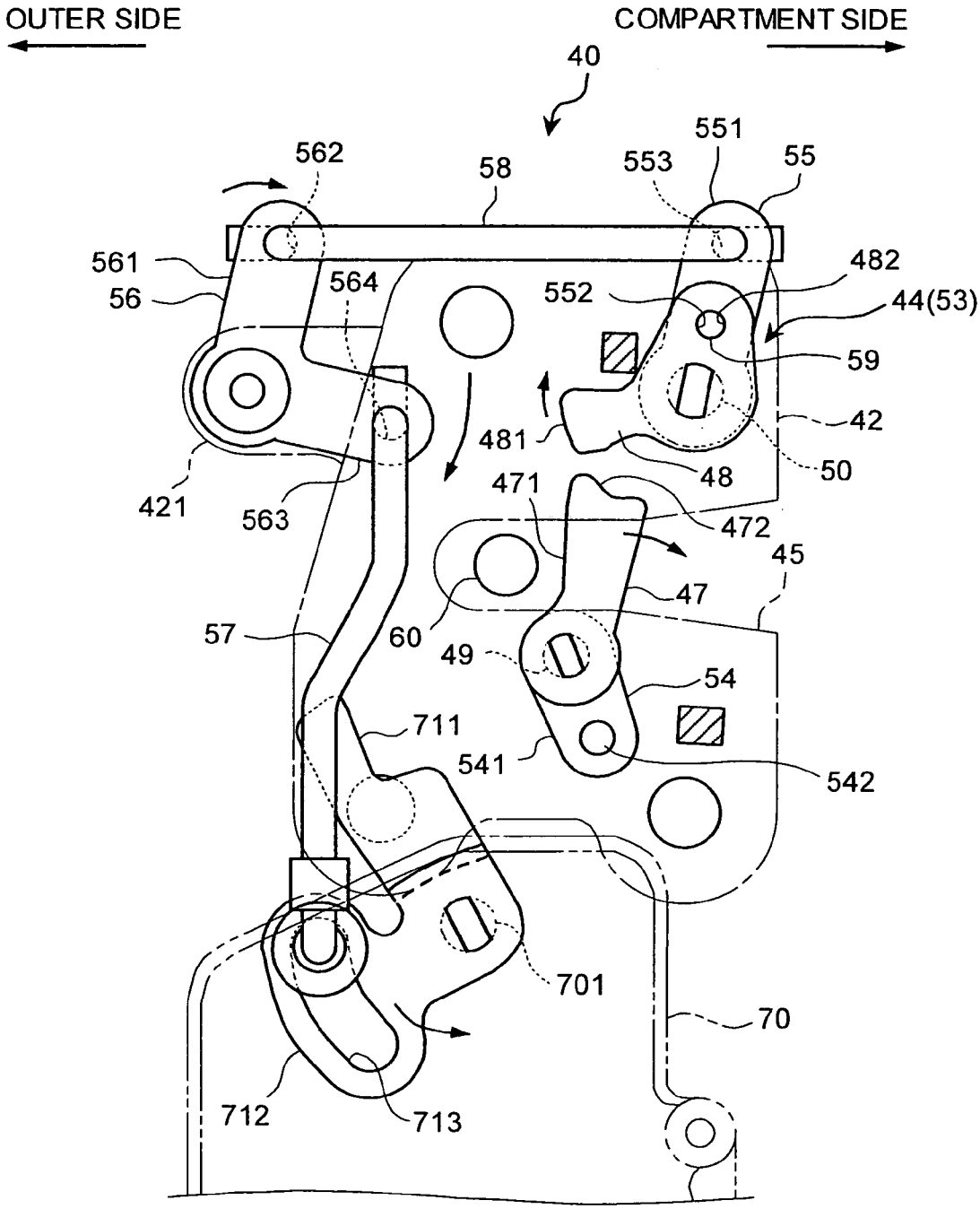
FIG. 3D is a rear external view of the door connector without a cover plate when the front door and the rear door are disconnected.

When the front door 2 and the rear door 3 are closed and the latch 47 is rotated in a counterclockwise direction, the striker engagement member 471 engages with the striker 60 (see FIG. 3C). As shown in FIG. 3C, when the latch 47 is rotated in a counterclockwise direction, the striker engagement member 471 moves across the horizontal notch 45 of the latch mechanism housing 44 (latch position). As shown in FIG. 3A, when the latch 47 is rotated in a clockwise direction, the striker engagement member 471 moves away from the horizontal notch 45 (open position).

When the front door 2 and the rear door 3 are closed and the latch 47 is rotated in a counterclockwise direction, the ratchet engagement member 472 is positioned above the horizontal notch 45 (see FIG. 3C). When the latch 47 is rotated in a clockwise direction, the ratchet engagement member 472 is positioned towards the compartment side (see FIG. 3A). As shown in FIG. 3C, when the latch 47 is rotated in a counterclockwise direction, the ratchet engagement member 472 comes in contact with the ratchet 48 (latch position). As shown in FIG. 3A, when the latch 47 is rotated in a clockwise direction, the ratchet engagement member 472 moves away from the ratchet 48 (open state).

The latch 47 is biased in a clockwise direction by means of a latch spring (not shown).

The ratchet 48 can be rotated by means of a ratchet bar 50 that extends substantially horizontally in the anteroposterior direction in a position symmetrical to that of the latch bar 49 with the horizontal notch 45 of the latch mechanism housing 44 taken as standard. The ratchet 48 includes a latch engagement member 481 and an action member 482.

As shown in FIG. 3A, the latch engagement member 481 extends in a radially outward direction from the ratchet bar 50 towards the outer side of the car 1. When the ratchet 48 is rotated in a clockwise direction, the protruding edge of the latch engagement member 481 can come in contact with the ratchet engagement member 472 of the latch 47. The action member 482 is a hole that is positioned on a circle of a predetermined radius with the ratchet bar 50 at the center.

The ratchet 48 is biased in a counterclockwise direction by means of a ratchet spring (not shown).

The latch mechanism housing 44 that houses the latch mechanism is covered by an open-box-shaped cover plate (not shown) that wraps around the compartment side and the outer side of the car 1 and faces the front side of the car 1. The cover plate is, for example, made of metal and is provided with a notch (not shown) having substantially the same shape as that of the horizontal notch 45 so that the striker 60 can move into the horizontal notch 45 provided in the latch mechanism housing 44.

A door connecting mechanism housing 53 extending on the either side of the front door 2 is provided on the surface of the housing 42 facing the front side of the car 1. The door connecting mechanism housing 53 houses the door connecting mechanism. When the front door 2 and the rear door 3 are closed and the latch 47 is rotated in a counterclockwise direction, the door connecting mechanism causes the latch 47 to engage with the ratchet 48, thereby connecting the front door 2 and the rear door 3. If a passenger opens either the front door 2 or the rear door 3 (by operating the inside handles 14, 23 or the outer handles 15, 24) when the latch 47 is engaged with the ratchet 48 and the two doors are connected (i.e., when the front door 2 and the rear door 3 are closed), the ratchet 48 is rotated in a clockwise direction, thereby getting disengaged from the latch 47, and the front door 2 as well as the rear door 3 can be opened.

The door connecting mechanism includes a latch linking mechanism that links the door connecting mechanism to the latch 47 and a ratchet linking mechanism that links the door connecting mechanism to the ratchet 48. The latch linking mechanism includes a latch lever 54. The ratchet linking mechanism includes a ratchet lever 55, a bell crank 56, a pull rod 57, and a push rod 58.

The latch lever 54 is integrally fixed to the latch bar 49 and rotates along with the latch 47 in the same direction. The latch lever 54 includes a lever member 541 and a convex action member 542. As shown in FIG. 3A, the lever member 541 extends from the latch bar 49 inclining downwards towards the outer side of the car 1 when the latch 47 has moved away from the horizontal notch 45. As shown in FIG. 3C, the lever member 541 is inclined downwards from the latch bar 49 towards the compartment side of the car 1 when the latch 47 is intersecting with the horizontal notch 45. The convex action member 542 is a protrusion on the edge of the lever member 541, which extends in the anterior direction of the car 1.

The ratchet lever 55 is integrally fixed to the ratchet bar 50 and rotates along with the ratchet 48 in the same direction. The ratchet lever 55 includes a lever member 551 and an action member 552. The lever member 551 extends from the ratchet bar 50 inclining upwards towards the outer side of the car 1. The action member 552 connects with the action member 482 of the ratchet 48. The action member 552 and the action member 482 of the ratchet 48 are connected by means of a pin 59. A bracket hole 553 is disposed on the edge of the lever member 551.

The bell crank 56 is rotatably fixed to a bell crank bracket 421 that extends from the upper part of the housing 42 towards the outer side of the car 1. The bell crank 56 is substantially L shaped with its intersecting part being the pivot. A bracket hole 562 is disposed on an extremity 561 of the bell crank 56. The bracket hole 562 is connected to the edge (the bracket hole 553) of the lever member 551 of the ratchet lever 55 by the push rod 58. The bell crank 56 and the ratchet lever 55 are linked to rotate together. A bracket hole 564 disposed on another extremity 563 of the bell crank 56 is connected to one end of the pull rod 57.

The back plate covers the door connecting mechanism housing 53 that houses the door connecting mechanism. The back plate, for example, is made of metal in the same manner as the cover plate.

The housing 42 is sandwiched between the back plate and the cover plate, and a pin (not shown) penetrates through the cover plate, the back plate, and the housing 42 to form an integrated structure. The cover plate, the back plate, and the housing 42 can also be integrated by providing a through hole on either the cover plate or the back plate, a screw bracket on the other plate, inserting a screw from the through hole and screwing it to the screw bracket.

One actuator 70 is fixed to the cover plate. This actuator 70 selectively operates the latch linking mechanism and the ratchet linking mechanism. An actuator lever 71 is fixed to a power bar 701 of the actuator 70. The actuator lever 71 includes a latch lever action member 711 and a bell crank action member 712. The latch lever action member 711 extends upwards from the power bar 701 of the actuator 70. When the latch linking mechanism is selected and the power bar 701 of the actuator 70 is rotated in a clockwise direction, the latch lever action member 711 of the actuator lever 71 comes in contact with the convex action member 542 of the latch lever 54 and rotates the latch lever 54 in a counterclockwise direction (latch direction). Even if the power bar 701 of the actuator 70 is rotated in a counterclockwise direction, because the latch lever action member 711 of the actuator lever 71 and the convex action member 542 of the latch lever 54 are separated, the movement of the latch lever 54 is not affected.

The bell crank action member 712 is located on the left of the power bar 701 of the actuator 70 and includes an arc-shaped bracket hole 713 around the power bar 701. One end of the pull rod 57 is slidably fixed to the bracket hole 713. When the ratchet linking mechanism is selected and the power bar 701 of the actuator 70 is rotated in a counterclockwise direction, the actuator lever 71 pulls the pull rod 57 and rotates the bell crank 56 in a clockwise direction. Even if the power bar 701 of the actuator 70 is rotated in a clockwise direction, the pull rod 57 slides (idly runs) into the bracket hole 713 of the bell crank action member 712, and the movement of the bell crank 56 is not affected. By making the bell crank 56 rotate in a clockwise direction, the ratchet lever 55 is rotated in a clockwise direction, thereby disengaging the ratchet 48 and the latch 47.

The actuator 70 is fixed to the cover plate. However, the actuator 70 can also be fixed to the back plate or the front door 2.

Figure 4:
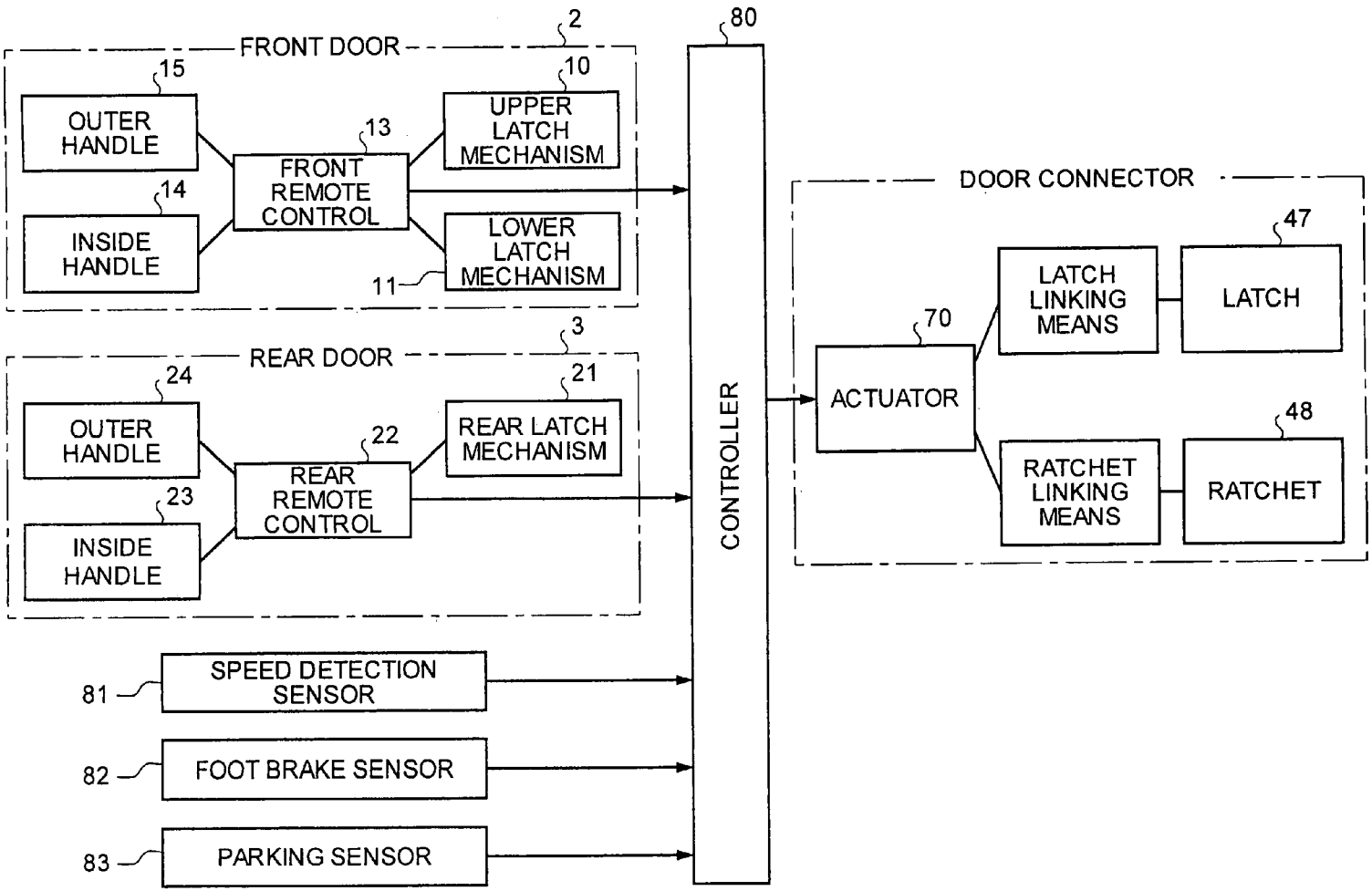
FIG. 4 is a block diagram of relevant parts that control the door connector.

FIG. 4 is a block diagram of relevant parts that control the door connector. A controller 80 controls the operations of the door connector. The controller 80 also controls the operations of the front remote control 13, the rear remote control 22, a speed detection sensor 81, a foot brake sensor 82, and a parking sensor 83.

When a passenger operates either the inside handle 14 or the outer handle 15 to open the front door 2, the front remote control 13 sends a front door opening signal to the controller 80. When the front door 2 is in a closed state, in other words, when the front door 2 is closed with the aid of the upper latch mechanism 10 and the lower latch mechanism 11, the front remote control 13 sends a front door closing signal to the controller 80.

Similarly, when a passenger operates either the inside handle 23 or the outer handle 24 to open the rear door 3, the rear remote control 22 sends a rear door opening signal to the controller 80. When the rear door 3 is in a closed condition, in other words, when the rear door 3 is closed with the aid of the rear latch mechanism 21, the rear remote control 22 sends a rear door closing signal to the controller 80.

The speed detection sensor 81 detects the speed of the car 1 and sends a signal that represents the speed to the controller 80. When brakes are applied to the car 1 by operating a foot brake (not shown), the foot brake sensor 82 sends a foot brake operation signal to the controller 80. When the car 1 is parked, the parking sensor 83 sends a parking signal to the controller 80. In an automatic transmission car, the parking sensor 83 sends the parking signal to the controller 80 when the auto transmission is in parking range. In a manual transmission car, the parking sensor 83 sends the parking signal to the controller 80 when the hand brakes are applied.

Figure 5:
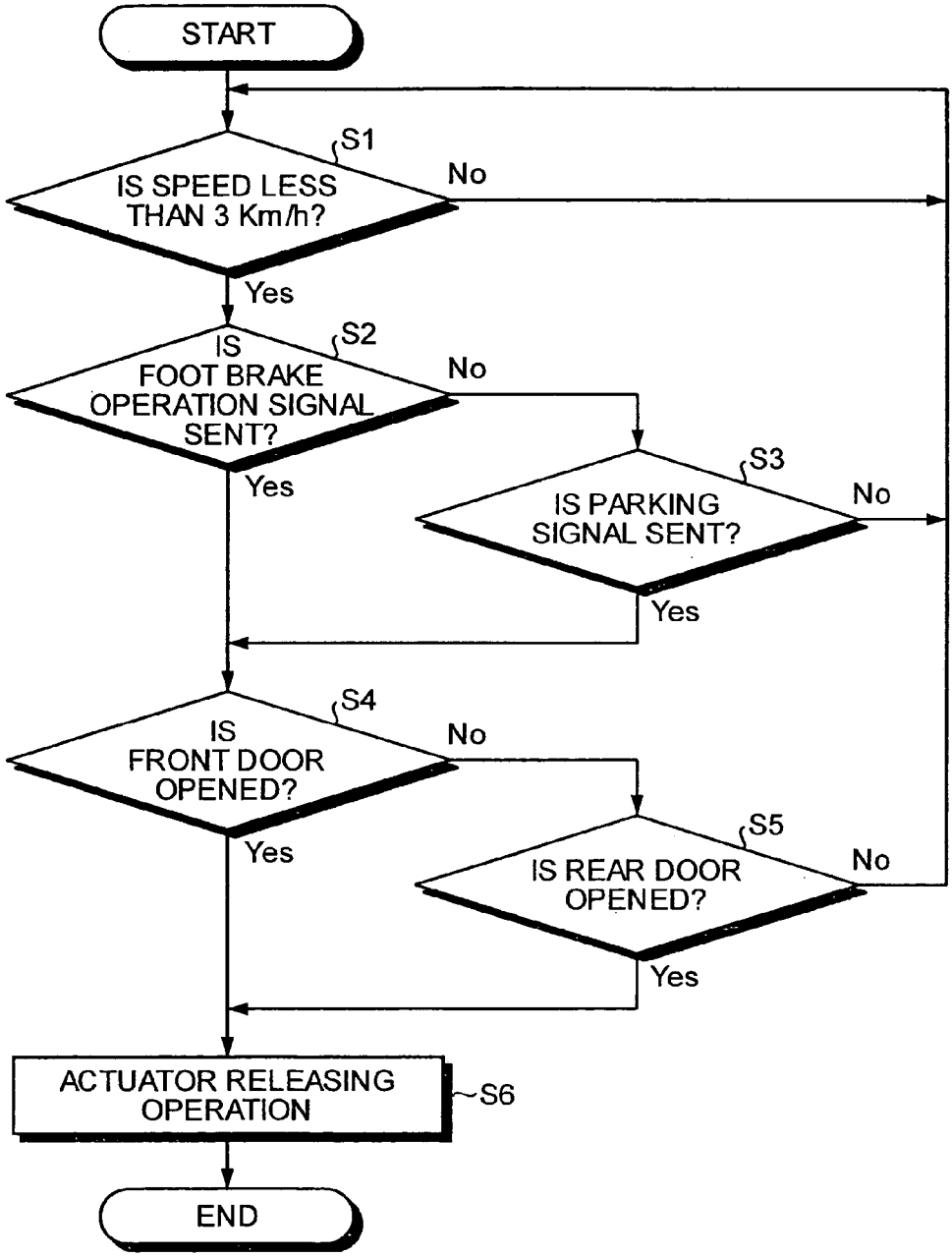
FIG. 5 is a flowchart of the process procedure performed by the door connector when disconnecting the front door and the rear door.

In this manner, the controller 80 controls the door connector based on the front door closing signal, the front door opening signal, the rear door closing signal, the rear door opening signal, the speed, and the parking signal when the car 1 satisfies certain halt conditions or running conditions. As shown in FIG. 5, the car 1 is considered to satisfy the halt conditions when the speed detection sensor 81 detects that the speed of the car 1 is less than 3 Km/h ("Yes" at step S1), and when the foot brake sensor 82 sends the foot brake operation signal to the controller 80 ("Yes" at step S2) or when the parking sensor 83 sends the parking signal to the controller 80 ("Yes" at step S3). The car 1 is considered to satisfy the running conditions when it does not satisfy the halt conditions. To be specific, when the speed detection sensor 81 detects that the speed of the car 1 is greater than 3 Km/h ("Yes" at step S13) as shown in FIG. 6.

When the lock unlock knobs 16, 25 are in an unlocked condition and the car 1 satisfies the halt conditions ("Yes" at step S1 and "Yes" at step S2 or "Yes" at step S3), the opening operation of the front door 2 or the rear door 3 is enabled as shown in FIG. 5. When a passenger operates any one of the inside handles 14, 23, or the outer handles 15, 24 to open either the front door 2 or the rear door 3 ("Yes" at step S4 or "Yes" at step S5), power is fed to the actuator 70, and the power bar 701 of the actuator 70 is rotated in a counterclockwise direction (step S6). The actuator lever 71 also rotates in a counterclockwise direction along with the power bar 701 and pulls the pull rod 57 connected to the bracket hole 713 of the bell crank action member 712. Because the latch lever action member 711 of the actuator lever 71 and the convex action member 542 of the latch lever 54 are separated, the movement of the latch lever 54 is not affected. In other words, the latch linking mechanism is not operated.

Pulling of the pull rod 57 causes the bell crank 56 to rotate in a clockwise direction, thereby pushing the push rod 58. When the push rod 58 is pushed, the ratchet lever 55 rotates in a clockwise direction, causing the ratchet 48 to rotate in a clockwise direction, and the ratchet 48 is disengaged from the latch 47. Thus, the latch 47 is disengaged from the striker 60 provided on the rear door 3, thereby disconnecting the front door 2 and the rear door 3 connected to each other. Next, the front remote control 13 of the front door 2 operates the upper latch mechanism 10 and the lower latch mechanism 11 to open the front door 2, or the rear remote control 22 of the rear door 3 operates the rear latch mechanism 21 to open the rear door 3. The upper latch mechanism 10 and the lower latch mechanism 11 release the closed state of the front door 2, or the rear latch mechanism 21 releases the closed state of the rear door 3. Thus, the front door 2 or the rear door 3 can be opened. When either the front door 2 or the rear door 3 is opened, the striker 60 is disengaged from the horizontal notch 45.

Figure 6:
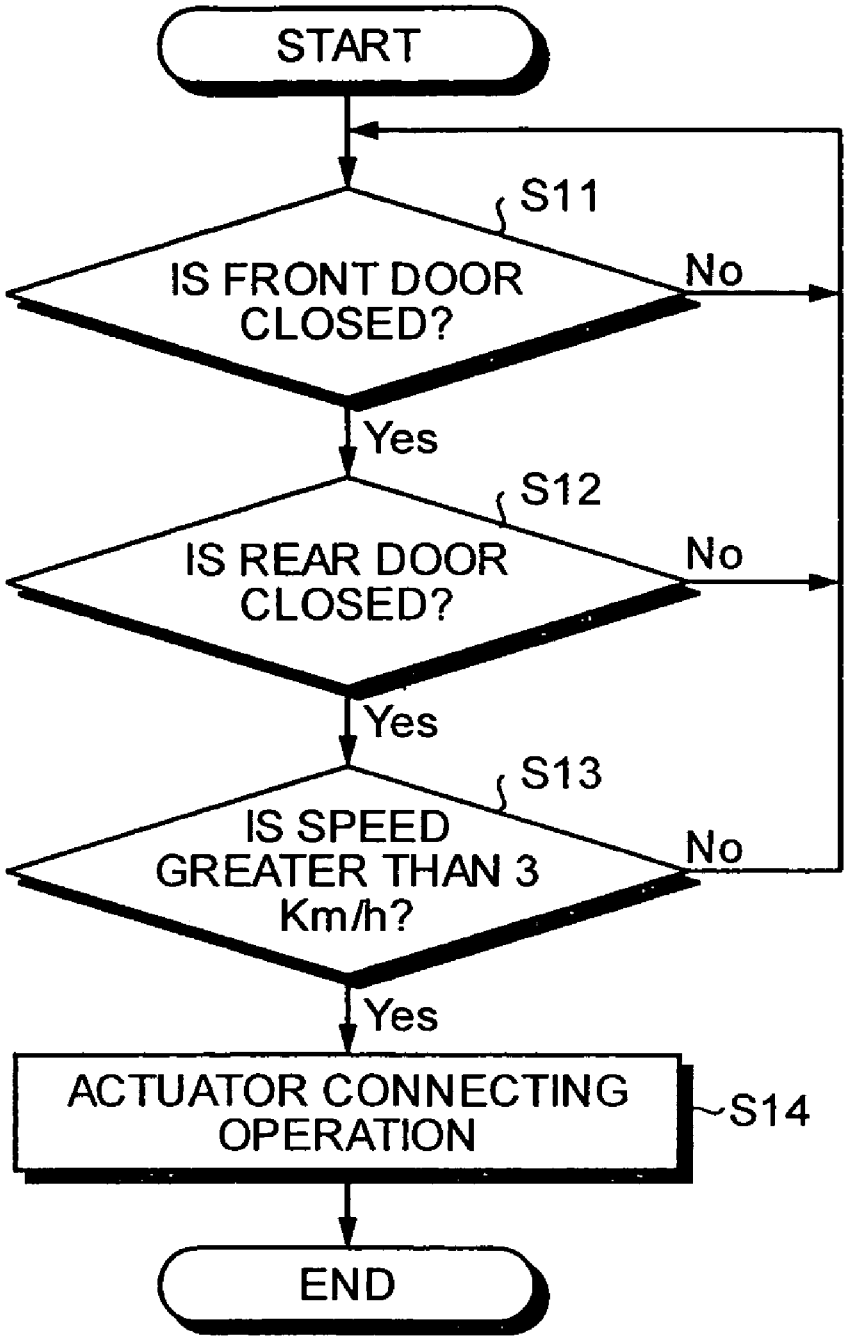
FIG. 6 is a flowchart of the process procedure performed by the door connector when connecting the front door and the rear door.

As shown in FIG. 6, when both the front door 2 and the rear door 3 are closed ("Yes" at step S11 and "Yes" at step S12), the striker 60 moves into the horizontal notch 45. When the front door 2 and the rear door 3 are closed, the upper latch mechanism 10, the lower latch mechanism 11, and the rear latch mechanism 21 engage with not shown strikers provided on the car 1, thereby maintaining the closed condition of the front door 2 and the rear door 3 respectively.

When the car 1 satisfies the running conditions (step S13), in other words, when the speed detection sensor 81 detects that the speed of the car 1 is greater than 3 Km/h, power is fed to the actuator 70 and the power bar 701 of the actuator 70 is rotated in a clockwise direction (step S14). The actuator lever 71 also rotates in a clockwise direction along with the power bar 701. Because the pull rod 57 slides (idly runs) into the bracket hole 713 of the bell crank action member 712 of the actuator lever 71, the movement of the bell crank 56 is not affected.

Next, the latch lever action member 711 of the actuator lever 71 comes in contact with the convex action member 542 of the latch lever 54, causing the latch lever 54 to rotate in a counterclockwise direction (latch direction), and the latch 47 engages with the ratchet 48. Thus, the striker 60 engages with the latch 47, thereby connecting the front door 2 and the rear door 3.

Even if both the front door 2 and the rear door 3 are closed and the car 1 satisfies the running conditions, the actuator 70 may not be able to connect the front door 2 and the rear door 3 due to a breakdown of the latch linking mechanism etc. The passengers can be alerted by sounding a warning alarm (warning mechanism) such as a buzzer provided in the car 1, or by lighting an interior lamp, an indicator lamp (warning mechanism) etc. and informed of the two doors not being connected. Whether the front door 2 and the rear door 3 are connected can be detected by providing a detection mechanism such as a sensor that detects the rotations of the latch 47.

By providing a warning alarm that alerts the passengers, the passengers can be alerted and informed of the two doors not being connected when the actuator 70 is not able to connect the front door 2 and the rear door 3 due to a breakdown of the latch linking mechanism. Thus, parts where a breakdown has occurred can be detected and measures such as repairs etc. can be undertaken.

The front door 2 and the rear door 3 can be opened independently, and when both the doors are closed, the striker 60 provided on the rear door 3 engages with the latch device 40 provided on the front door 2, thereby strongly connecting the two doors. Thus, the seam of the front door 2 and the rear door 3 does not cave in considerably in the event of a lateral collision, and the safety of the passengers can be secured.

The actuator 70 selects the latch lever 54 linked to the latch 47 to connect the front door 2 and the rear door 3, and selects the ratchet lever 55, the push rod 58, the bell crank 56, and the pull rod 57 linked to the ratchet 48 to disconnect the front door 2 and the rear door 3 connected to each other, thereby enabling the front door 2 and the rear door 3 to be connected to or disconnected from each other by using the single actuator 70. Thus, a cheap door connector can be provided.

When both the front door 2 and the rear door 3 are closed and the car 1 satisfies the running conditions, the actuator 70 operates the latch linking mechanism linked to the latch 47 causing the latch 47 to engage with the striker 60, thereby connecting the front door 2 and the rear door 3. Thus, the door connector does not operate when the car 1 is not running even if the passengers repeatedly get into or get out of the car 1. This reduces the number of operations of the door connector, thereby prolonging the life of the door connector.

When both the front door 2 and the rear door 3 are connected and either of the two doors is opened, the actuator 70 operates the ratchet linking mechanism provided on the front door 2, which is linked to the ratchet 48 to disengage the latch 47 and the striker 60, thereby disconnecting the front door 2 and the rear door 3 connected to each other. Thus, when the passengers get in or get out from the car 1, the front door 2 and the rear door 3 can be disconnected by opening either of the two doors, and when the passengers do not get in or get out from the car 1, the connected condition of the two doors can be maintained.

Figure 7:
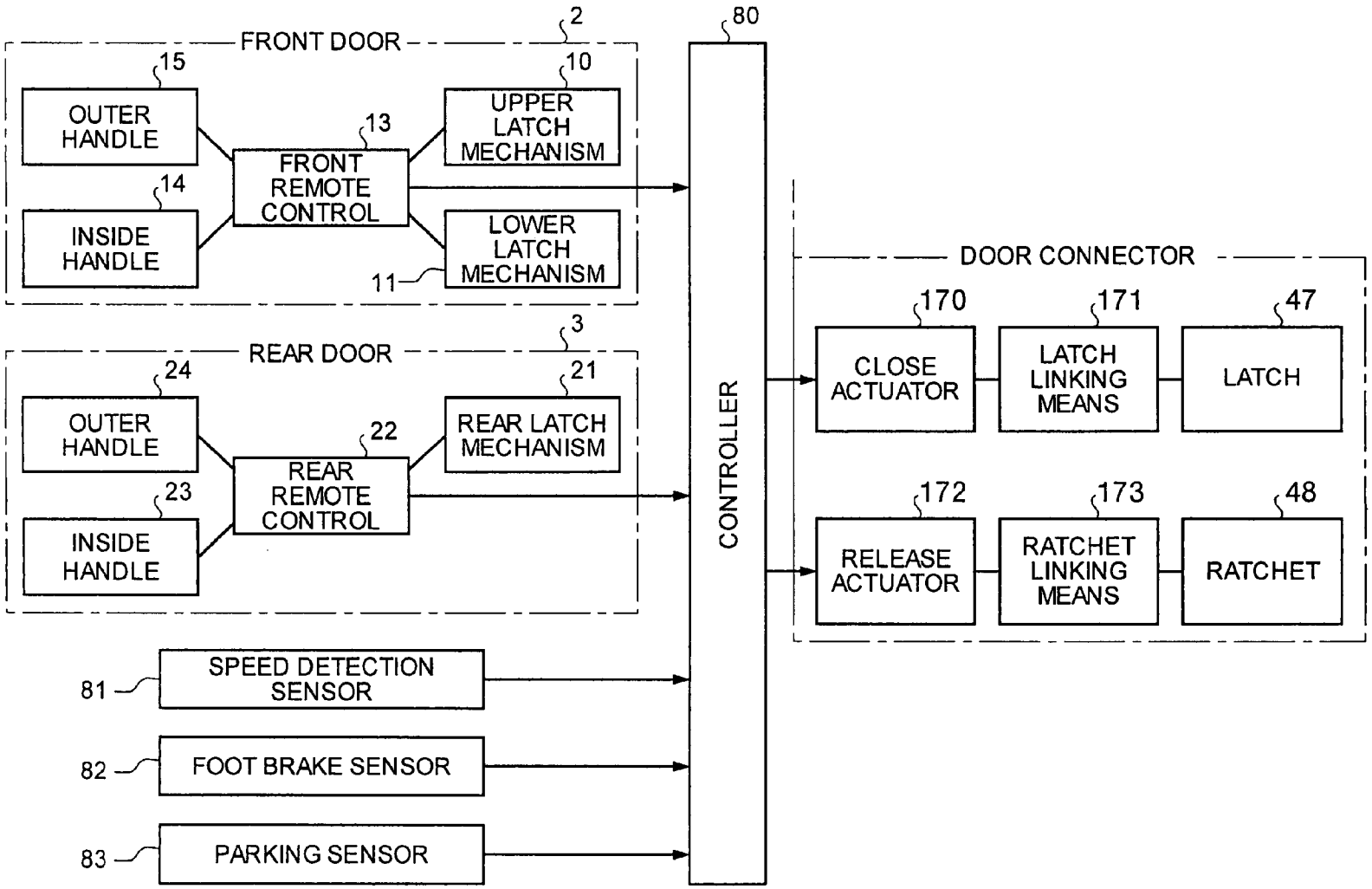
FIG. 7 is a block diagram of a door connector according to another embodiment of the present invention.

In the above-mentioned structure, the single actuator 70 selectively operates the latch 47 and the ratchet 48 to connect or disconnect the front door 2 and the rear door 3. However, as shown in FIG. 7, a close actuator 170 that operates a latch linking mechanism 171 linked to the latch 47 and a release actuator 172 that operates a ratchet linking mechanism linked to the ratchet 48 can be provided.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door connector for connecting a first door and a second door that close an opening formed in the anteroposterior direction of a car, comprising:

a striker provided on the first door;

a notch, a latch, and a ratchet that are provided on the second door, wherein the notch receives the striker, the latch engages with the striker, and the ratchet engages with the latch;

a latch linking mechanism linked to the latch;

a ratchet linking mechanism linked to the ratchet; and an actuator that selectively operates the latch linking mechanism and the ratchet linking mechanism, wherein the actuator operates the latch linking mechanism causing the latch to engage with the striker to connect the first door and the second door when both the first door and the second door are closed, and the actuator operates the ratchet linking mechanism causing the latch and the striker to be disengaged to disconnect the first door and the second door when both the first door and the second door are connected and either of the first door and the second is opened; and, wherein when either the first door or the second door is opened, the ratchet disengages from the latch, the latch disengages from the striker, and the latch completely moves away from the notch, and the latch crosses the notch when the latch is engaged with the ratchet, and one of the first door and the second door is a slide door.

2. The door connector according to claim 1, wherein the striker moves into the notch in a first direction when the first door is at a closed position and the second door is being closed, and the striker moves into the notch in a second direction which is different from the first direction when the second door is at a closed position and the first door is being closed.

3. The door connector according to claim 2, wherein the first direction is substantially right angle to the second direction.

4. The door connector according to claim 2, wherein the notch extends toward a third direction, the first direction is parallel to the third direction, and the second direction is substantially right angle to the third direction.

5. The door connector according to claim 4, wherein the first direction is a compartment side-outer side direction, and the second direction is the anteroposterior direction.

6. The door connector according to claim 1, wherein the first door is a slide door, and the second door is pivotably supported to the car.

7. The door connector according to claim 6, wherein the striker moves into the notch in a first direction when the first door is at a closed position and the second door is being closed, and the striker moves into the notch in a second direction which is different from the first direction when the second door is at a closed position and the first door is being closed.

8. The door connector according to claim 6, wherein the first direction is substantially right angle to the second direction.

9. The door connector according to claim 6, wherein the notch extends toward a third direction, the first direction is parallel to the third direction, and the second direction is substantially right angle to the third direction.

10. The door connector according to claim 9, wherein the first direction is a compartment side-outer side direction, and the second direction is the anteroposterior direction.

11. A door connector for connecting a first door and a second door that close an opening formed in the anteroposterior direction of a car, comprising:

a striker provided on the first door;

a notch, a latch, and a ratchet that are provided on the second door, wherein the notch receives the striker, the latch engages with the striker, and the ratchet engages with the latch;

a latch linking mechanism linked to the latch;

a ratchet linking mechanism linked to the ratchet; and an actuator that selectively operates the latch linking mechanism and the ratchet linking mechanism, wherein the actuator operates the ratchet linking mechanism causing the racket to disengage the latch, and the actuator also operates the latch linking mechanism causing the latch to engage with the striker to connect the first door and the second door when both the first door and the second door are closed at a time when the car satisfies a halt condition and a speed detection sensor indicates that the car satisfies predetermined running conditions, wherein when either the first door or the second door is opened, the ratchet disengages from the latch, the latch disengages from the striker, and the latch moves away from the notch, and one of the first door and the second door is a slide door.

12. The door connector according to claim 11, further comprising a warning mechanism that informs passengers of the car of the first door and the second door not being connected when the first door and the second door are not connected even if both the first door and the second door are closed and the car satisfies the running conditions.

13. The door connector according to claim 11, wherein the ratchet linking mechanism is provided on the second door, wherein the ratchet linking mechanism is linked to the ratchet, and wherein the ratchet linking mechanism is operated causing the latch and the striker to be disengaged to disconnect the first door and the second door when both the first door and the second door are connected and either the first door or the second door is opened.

14. The door connector according to claim 11, wherein said running conditions comprises one of speed, braking and signaling condition.

15. The door connector according to claim 11, wherein said running conditions comprises speed over a predetermined value.

16. The door connector according to claim 11, wherein said running conditions comprises speed greater than 3 Km/h.

* * * * *